US007500636B2

(12) United States Patent
Bredy

(10) Patent No.: US 7,500,636 B2
(45) Date of Patent: Mar. 10, 2009

(54) PROCESSES AND DEVICES TO GUIDE AND/OR STEER A PROJECTILE

(75) Inventor: Thierry Bredy, Saint Doulchard (FR)

(73) Assignee: GIAT Industries, Versailles (FR)

( * ) Notice: Subject to any disclaimer, the term of this patent is extended or adjusted under 35 U.S.C. 154(b) by 314 days.

(21) Appl. No.: 11/178,470

(22) Filed: Jul. 12, 2005

(65) Prior Publication Data

US 2006/0289694 A1 Dec. 28, 2006

(30) Foreign Application Priority Data

Jul. 12, 2004 (FR) ..... 04 07773

(51) Int. Cl.
*F41G 7/00* (2006.01)
*F42B 15/01* (2006.01)
*F42B 15/00* (2006.01)

(52) U.S. Cl. ..... 244/3.15; 244/3.1; 244/3.24; 89/1.11

(58) Field of Classification Search ..... 244/3.1–3.3; 89/1.11; 701/1, 3, 200, 300
See application file for complete search history.

(56) References Cited

U.S. PATENT DOCUMENTS 2,984,783 A * 5/1961 Singer ..... 244/3.15
3,061,239 A * 10/1962 Rusk ..... 244/3.21
3,118,637 A * 1/1964 Fischell et al. ..... 244/3.21
3,291,419 A * 12/1966 Montague et al. ..... 244/3.15
3,765,621 A * 10/1973 Shigehara ..... 244/3.21
3,834,653 A * 9/1974 Perkel ..... 244/3.21
4,062,509 A * 12/1977 Muhlfelder et al. ..... 244/3.2
4,646,990 A * 3/1987 Cleveland, Jr. ..... 244/3.21
4,831,544 A * 5/1989 Hojo et al. ..... 244/3.2
5,740,986 A * 4/1998 Seidensticker et al. ..... 244/3.15
6,163,021 A * 12/2000 Mickelson ..... 244/3.2
6,345,785 B1 * 2/2002 Harkins et al. ..... 244/3.23
6,378,801 B1 * 4/2002 Pell et al. ..... 244/3.24
6,398,155 B1 * 6/2002 Hepner et al. ..... 244/3.15
6,493,651 B2 * 12/2002 Harkins et al. ..... 244/3.15
6,496,779 B1 * 12/2002 Hwang ..... 244/3.1
6,556,896 B1 * 4/2003 Meyer ..... 244/3.1
6,725,173 B2 * 4/2004 An et al. ..... 244/3.2
2002/0059027 A1 5/2002 An et al.

FOREIGN PATENT DOCUMENTS

DE 31 31 394 A1 3/1983
DE 38 29 573 A1 3/1990
EP 1 273 874 A 1/2003

* cited by examiner

*Primary Examiner*—Bernarr E Gregory
(74) *Attorney, Agent, or Firm*—Oliff & Berridge, PLC

(57) ABSTRACT

A terminal guidance and/or steering process for a projectile towards a target, process in which the orientation of a velocity vector $\overrightarrow{Vp}$ is determined then a guidance law is applied and finally a steering algorithm enabling the projectile to be reoriented towards its target, process wherein the three components of the terrestrial magnetic field $\overrightarrow{H}$ are measured in a projectile-linked reference marker ($Ox_mY_mZ_m$) and these measurements are used in the guidance law and/or steering algorithm as a fixed reference marker enabling the orientation at least partially of the projectile-linked reference marker with respect to the terrestrial reference marker ($GX_fY_fZ_f$).

11 Claims, 7 Drawing Sheets

PROCESSES AND DEVICES TO GUIDE AND/OR STEER A PROJECTILE

BACKGROUND OF THE INVENTION

1. Field of the Invention

The technical scope of the invention is that of processes and devices to guide and/or steer a projectile towards a target.

2. Description of the Related Art

Known projectiles are guided towards their target by a guiding device which establishes acceleration correction commands to be applied to the projectile to direct it to the target.

These correction commands are then used by a steering device which establishes the commands to be applied to the steering organs so as to ensure the required correction.

Thus, autonomous projectiles are known that have a satellite positioning system (more commonly known by the acronym "Global Positioning System" or GPS) which enables them to be located on a trajectory. Before being fired, the projectile is programmed with the coordinates of the target. It thus determines its in-flight position itself and establishes, using data supplied by an inertial measurement unit on-board and by means of appropriate algorithms, the commands to be transmitted to the fins.

This inertial measurement unit comprises accelerometers and gyrometers (or gyroscopes) which supply (in a projectile-linked reference marker) the components of the instantaneous rotation vector and non-gravitational acceleration to which the projectile is subjected. This inertial measurement unit is implemented both to ensure the steering of the projectile and contributes to its guidance by combining the data from this unit with that supplied by the GPS.

It is also known to produce projectiles incorporating a target detector enabling it to be located in space.

In this case, the guiding and steering set points are established from the direction of location of the target with respect to the projectile (line of sight) and also from the data related to the spin of this line of sight with respect to a fixed reference marker (first approximation terrestrial reference marker) expressed in a projectile-linked reference marker.

The movements of the line of sight are measured with respect to a projectile-linked reference marker, whereas in order to guide the projectile the movements of the line of sight with respect to a fixed reference marker need to be known.

Data regarding the behavior of the projectile with respect to a fixed reference marker is obtained by using an inertial measurement unit. It is thus possible for the movements of the line of sight to be determined with respect to a fixed reference marker. Once again, this inertial measurement unit is implemented both to ensure the steering of the projectile and contributes to its guidance.

It is thus possible for the correction acceleration for the projectile to be defined in a projectile-linked reference marker for it to reach the target.

If these solutions are well adapted to missile-type projectiles, they cannot be used for cannon-fired projectiles because of the lack of robustness of the gyrometers and the excessive cost of these measurement components.

SUMMARY OF THE INVENTION

The aim of the invention is to propose a terminal guidance and/or steering process for a projectile towards a target that enables such drawbacks to be overcome.

Thus, the process according to the invention ensures the guidance and/or steering without implementing gyrometers whilst ensuring a level of accuracy almost equivalent to that obtained using known guidance/steering devices.

Thus, the invention relates to a terminal guidance and/or steering process for a projectile towards a target, process in which the orientation of a velocity vector $\overrightarrow{Vp}$ is determined then a guidance law is applied and finally a steering algorithm enabling the projectile to be reoriented towards its target, process wherein the three components of the terrestrial magnetic field $\overrightarrow{H}$ are measured in a projectile-linked reference marker and these measurements are used in the guidance law and/or steering algorithm as a fixed reference marker enabling the orientation at least partially of the projectile-linked reference marker with respect to the terrestrial reference marker.

According to one embodiment, the invention relates to a guidance and/or steering process in which a target detector is implemented that enables the target to be detected in a projectile-linked reference marker, and the coordinates of a line of sight vector $\overrightarrow{Los}$ to be deduced between the target and projectile, process wherein, to ensure steering:

in the projectile-linked reference marker, the projection $\overrightarrow{N}$ of the terrestrial magnetic field $\overrightarrow{H}$ is determined in a guidance plane defined by the projectile's line of sight $\overrightarrow{Los}$ and velocity $\overrightarrow{Vp}$ vectors, a guidance law proportional to the variation with respect to time $\dot{\lambda}=d\lambda/dt$ of angle $\lambda$ between this projection $\overrightarrow{N}$ of the magnetic field and the line of sight vector $\overrightarrow{Los}$.

The guidance law may namely be expressed in the following way: $\overrightarrow{\gamma}_{cmd}=K\dot{\lambda}\,\overrightarrow{u}$, expression in which $\overrightarrow{\gamma}_{cmd}$ represents the correction set point acceleration vector, $\dot{\lambda}$ represents the variation with respect to time ($d\lambda/dt$) of angle $\lambda$ between the projection $\overrightarrow{N}$ of the magnetic field and the line of sight vector $\overrightarrow{Los}$ and $\overrightarrow{u}$ represents a unitary vector perpendicular to the velocity vector $\overrightarrow{Vp}$ of the projectile and located in the guidance plane.

According to one variant, to determine the orientation of the projectile's velocity vector in the projectile-linked reference marker, we can consider that this vector is collinear to the axis $OX_m$ of the projectile-linked reference marker.

According to another variant, to determine the orientation of the projectile's velocity vector in the projectile-linked reference marker, we can use the signals supplied by at least two accelerometers oriented respectively along the axes of measurement in pitch ($OY_m$) and yaw ($OZ_m$) of the projectile.

According to another embodiment, the invention relates to a guidance and/or steering process in which, to ensure steering by servo-controlling the positioning of the fins in yaw and/or pitch:

the projection of the magnetic field vector is determined in one of the yaw ($X_mOY_m$) or pitch ($X_mOZ_m$) planes of the projectile, a servo-control chain is used in yaw and/or pitch in place of the yaw and/or pitch spin rate, the derivative with respect to time of an angle made by the projection thus made with one of the axes of the plane in question.

Such an operation amounts to replacing the gyrometric feedback of the yaw and/or pitch servo-control chain by a "pseudo-gyrometric" feedback generated by measurements of the magnetic field.

In particular, to servo control the yaw positioning of the fins, we may:

determine the projection of the magnetic field vector on the projectile's yaw plane ($X_mOY_m$), compute the variation with respect to time ($r_{mes}=d\rho_2/dt$) of angle $\rho_2$ made by this projection with the roll axis ($OX_m$), in a yaw servo control chain, use value $r_{mes}$ thus computed (pseudo-gyrometric feedback) in place of the yaw spin rate measurement r.

To servo control the pitch positioning of the fins, we may:

determine the projection of the magnetic field vector on the projectile's pitch plane ($X_mOZ_m$), compute the variation with respect to time ($q_{mes}=d\rho_2/dt$) of angle $\rho_1$ made by this projection with the yaw axis ($OZ_m$), in a pitch servo control chain, use value $q_{mes}$ thus computed (pseudo-gyrometric feedback) in place of the pitch spin rate measurement q.

To servo control the roll positioning of the fins, we may:

determine the projection of the magnetic field vector on the projectile's roll plane ($Z_mOY_m$), measure the angle $\rho_3$ made by this projection with one of the axes of said plane (for example the pitch spin axis ($OY_m$))

in a roll servo control chain, use value $\rho_3$ thus computed in place of roll angle $\Phi$.

By way of a variant, this steering process may be combined with a classical projectile guidance law such as a tracking law.

The invention also relates to a guidance and/or steering device for a projectile towards a target that implements such a process, such device wherein it associates a target detector or deviation finder, a computer incorporating a projectile guidance and/or steering algorithm, projectile steering means, at least two accelerometers oriented along the projectile's pitch acceleration ($OZ_m$) and yaw acceleration ($OY_m$) measurement axes and one or several magnetic sensors arranged so as to measure the three components of the terrestrial magnetic field vector $\vec{H}$ in a projectile-linked reference marker, the guidance and/or steering algorithm using components of the terrestrial magnetic field vector $\vec{H}$ as a fixed reference marker enabling the projectile-linked reference marker to be at least partially oriented with respect to a terrestrial reference marker.

BRIEF DESCRIPTION OF THE DRAWINGS

The invention will become more apparent from the following description made of a particular embodiment, such description made with reference marker to the appended drawings, in which.

DETAILED DESCRIPTION OF PREFERRED EMBODIMENTS

Figure 1:
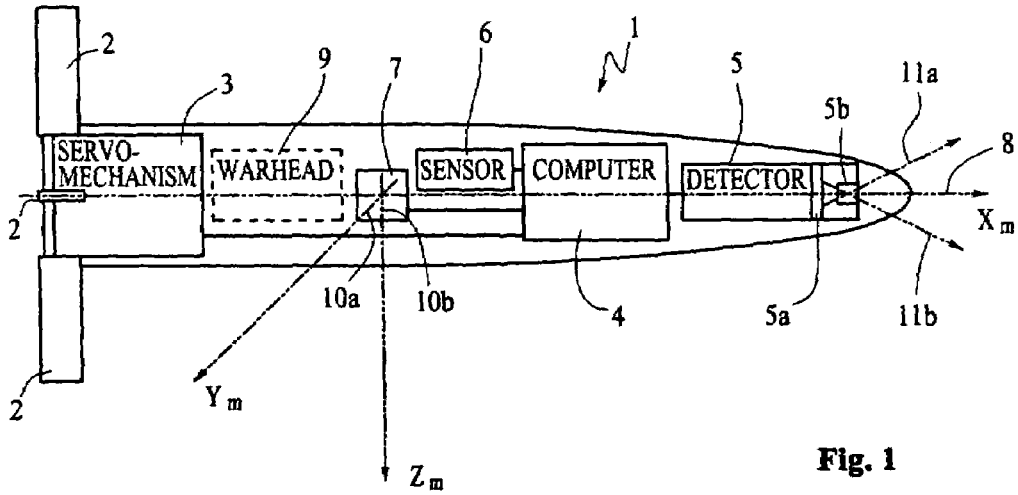
FIG. 1 is a schema showing a projectile implementing a guidance and/or steering device according to the invention.

FIG. 1 schematically shows an embodiment of a projectile 1 implementing a guidance and/or steering device according to the invention.

The projectile 1 is fitted at its rear part with four pivoting steering fins 2. Each fin 2 is activated by steering means or a servomechanism 3, itself controlled by an on-board computer 4. This projectile is, for example, a projectile fired by an artillery cannon at a target.

When the projectile is inside the barrel of a weapon (not shown) the fins are folded along the projectile body 1. They deploy upon exiting the barrel to fulfill their steering function. These deployment mechanisms are classical and do not require further description here. Reference may be made, for example, to patents FR2846079 and FR2846080 which describe steering fin deployment mechanisms.

The projectile 1 also encloses a warhead 9, for example a shaped charge, and explosive charge or else one or several scatterable sub-munitions.

The projectile 1 also encloses inertial means. These inertial means 7 comprise at least two accelerometers 10*a*, 10*b* oriented respectively along the yaw acceleration ($OY_m$) and pitch acceleration ($OZ_m$) measurement axes of the projectile 1. These axes are, as may be seen in FIG. 1, perpendicular to roll axis $OX_m$ (indistinguishable from the projectile axis 8).

In certain applications, gyrometers or gyroscopes may also be provided with the inertial means 7.

The inertial means are connected to the computer 4 which processes the measurements made and uses them for the subsequent guidance and/or steering of the projectile.

According to an essential characteristic of the invention, the projectile 1 also incorporates a triaxial magnetic sensor 6 (a single sensor or three magnetic or magneto-resistant probes spaced along three different directions of a measurement trihedron (for example three orthogonal probes each directed preferably along one of the projectile's reference marker axes ($OX_m$, $OY_m$ or $OZ_m$).

This sensor enables the components of the terrestrial magnetic field H to be measured in a projectile-linked reference marker 1.

The magnetic sensor 6 is also linked to the computer 4 which processes and later uses the measurements.

In the embodiment shown in FIG. 1, the projectile 1 also incorporates a target detector 5 mounted fixed with respect to the projectile 1.

Such detectors or deviation finders are well known to the Expert (they are usually known by the name of strapdown sensors). They comprise, for example, a matrix of optical sensors 5*a* onto which light rays from a field of observation delimited by lines 11*a*, 11*b* are projected. These light rays are supplied by an input optic sensor 5*b* oriented along axis $OX_m$ of the projectile 1.

A semi-active deviation finder may be implemented, for example, spotting a laser dot from an indicator reflected on a target. This deviation finder may be a four-quadrant photo detector (four detection zones delimited by two perpendicular lines).

Such a detector (with appropriate signal processing) enables the direction of the line of sight connecting the projectile to a target to be determined.

The detector 5 is also connected to the computer 4. The latter, once again, processes the measurements and ensures their subsequent employment. It will incorporate target detection and/or recognition algorithms for a specific target (for a passive or active detector) or algorithms to decode the signals from an indicator (for a semi-active detector). It will also incorporate algorithms which, once the target has been detected, enable the components of a line of sight to be computed in a projectile-linked reference marker.

Naturally, FIG. 1 is only an explanatory schema that does not prejudice the relative locations and dimensions of the different elements. In practical terms, a single projectile fuse may incorporate the computer 4, the magnetic sensors 6, the accelerometers 7 and the target detector 5.

Figure 2:
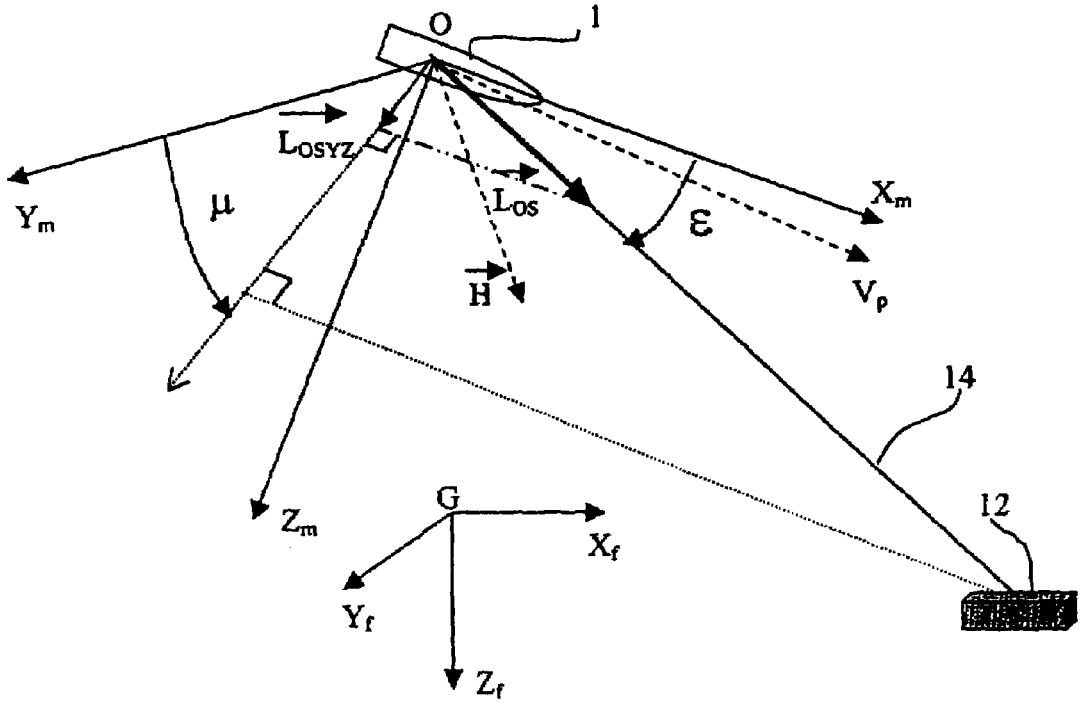
FIG. 2 is a schema showing the implementation of a guided and/or steered projectile using the process according to the invention, such schema enabling certain vectors, angles and references to be visualized.

FIG. 2 shows the projectile 1 and a target 12.

One reference marker $OX_mY_mZ_m$ linked to the projectile has the following axes:

$OX_m$ (roll spin axis)

$OY_m$ (pitch spin axis and also axis along which the yaw acceleration is measured), and $OZ_m$ (yaw spin axis and also the axis along which the pitch acceleration is measured).

The line of sight 14 is an imaginary straight line connecting the centre of gravity O of the projectile and the target 12. The unitary vector is noted $\overrightarrow{Los}$ on this line of sight.

A fixed terrestrial reference marker $GX_fY_fZ_f$ is also represented on this figure.

The position of the vector $\overrightarrow{Los}$ in the projectile-linked reference marker is determined by the two angles $\epsilon$ and $\mu$ marked on the Figure. $\epsilon$ is the angle between the vector $\overrightarrow{Los}$ and the roll axis $OX_m$, $\mu$ is the angle between the axis $OY_m$ and the projection $\overrightarrow{Los}_{YZ}$ of the vector $\overrightarrow{Los}$ on the plane $OY_mZ_m$.

The algorithms enabling angles $\epsilon$ and $\mu$ to be determined, and thus the coordinates of $\overrightarrow{Los}$ in a reference marker $OX_mY_mZ_m$ linked to the projectile, are well known to the Expert since they are implemented in any projectile using such a target detection system. It is thus unnecessary to describe them in detail. We will consider hereafter that the vector $\overrightarrow{Los}$ is known. These algorithms are incorporated into memories or registers in the computer 4.

FIG. 2 also shows the vector $\vec{H}$ which is the terrestrial magnetic field vector and vector $\overrightarrow{Vp}$ which is the velocity vector of the projectile with respect to a fixed reference marker at a given time.

The pitch plane of the projectile (perpendicular to the pitch spin axis $OY_m$) is noted $OX_mZ_m$ and the yaw plane of the projectile (perpendicular to the yaw spin axis $OZ_m$) is noted $Ox_mY_m$.

Classically, to guide the projectile 1 to its target, its velocity vector $\overrightarrow{Vp}$ must be controlled.

Figure 3:
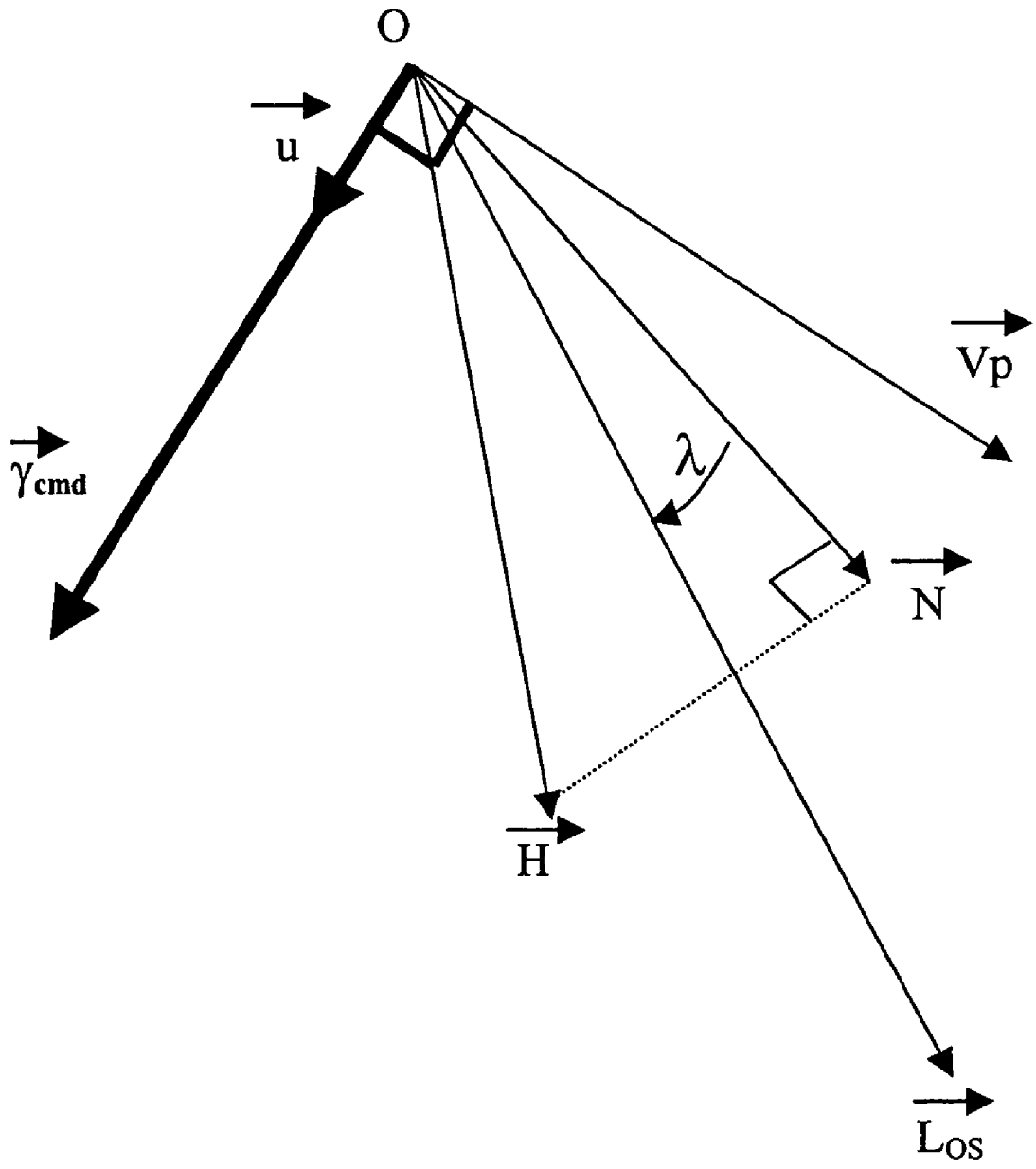
FIG. 3 is a schema showing the different vectors computed in the process according to the invention.

FIG. 3 enables the guidance process implemented in accordance with one embodiment of the invention to be explained.

The process is based on a classical proportional navigation law. In accordance with such a law, the velocity vector $\overrightarrow{Vp}$ is controlled by applying an acceleration $\vec{\gamma}_{cmd}$ perpendicular to this velocity vector and proportional to the spin rate of the line of sight Los with respect to a fixed reference marker.

Generally speaking, in known projectiles the projectile reference marker spin is determined with respect to the fixed reference marker by implementing gyrometers.

In accordance with the invention, the guidance process involves a simple measurement of the terrestrial magnetic field around the projectile. This measurement is used in the guidance process as a fixed reference marker with respect to the terrestrial reference marker. It is therefore pointless to implement gyrometers to determine the elements required to orient the projectile-linked reference marker with respect to the fixed reference marker.

FIG. 3 shows the projectile's velocity vector $\overrightarrow{Vp}$ and the line of sight vector $\overrightarrow{Los}$. These two vectors determine a plane (guidance plane) on which the terrestrial magnetic field vector $\vec{H}$ is projected (this projection is annotated $\vec{N}$).

The angle $\lambda$ is the angle between the line of sight vector $\overrightarrow{Los}$ and this projection $\vec{N}$ of the magnetic field.

$\vec{u}$ in this Figure represents the unitary vector perpendicular to the vector $\overrightarrow{Vp}$ and belonging to the guidance plane, such vector materializing the direction in which the acceleration correction set points $\vec{\gamma}_{cmd}$ must be applied.

In accordance with the invention, a law of proportional guidance will be applied to the projectile 1 with a variation with respect to time of angle $\lambda$ between the line of sight $\overrightarrow{Los}$ and the projection $\vec{N}$ of the terrestrial magnetic field vector on the guidance plane.

To proceed with the different computations, it is firstly essential to know the orientation of the projectile's velocity vector $\overrightarrow{Vp}$ in a projectile-linked reference marker.

In a simplified manner, we can consider that the vector is collinear to axis OXm of the projectile reference marker.

Such an approximation is enough in the applications for which the projectile has a low incidence on trajectory (angle between Vp and axis 8 of the projectile less than 8°).

The data supplied by the inertial means 7 (accelerometers 10*a*, 10*b*) may also be used. Knowing the accelerations to which the projectile is subjected makes it possible to know the aerodynamic stress to which it is subjected. In this case, by implementing classical flight mechanics relations which express the aerodynamic stresses withstood as a function of the square of the velocity and angles of incidence of the projectile, it is possible to deduce the angles of incidence of the projectile and thus the orientation of the Vp vector in the projectile-linked reference marker. To perform such an evaluation, a projectile velocity table will be used that is memorized in the computer 4 and any disturbances due to the wind will be ignored.

Figure 4:
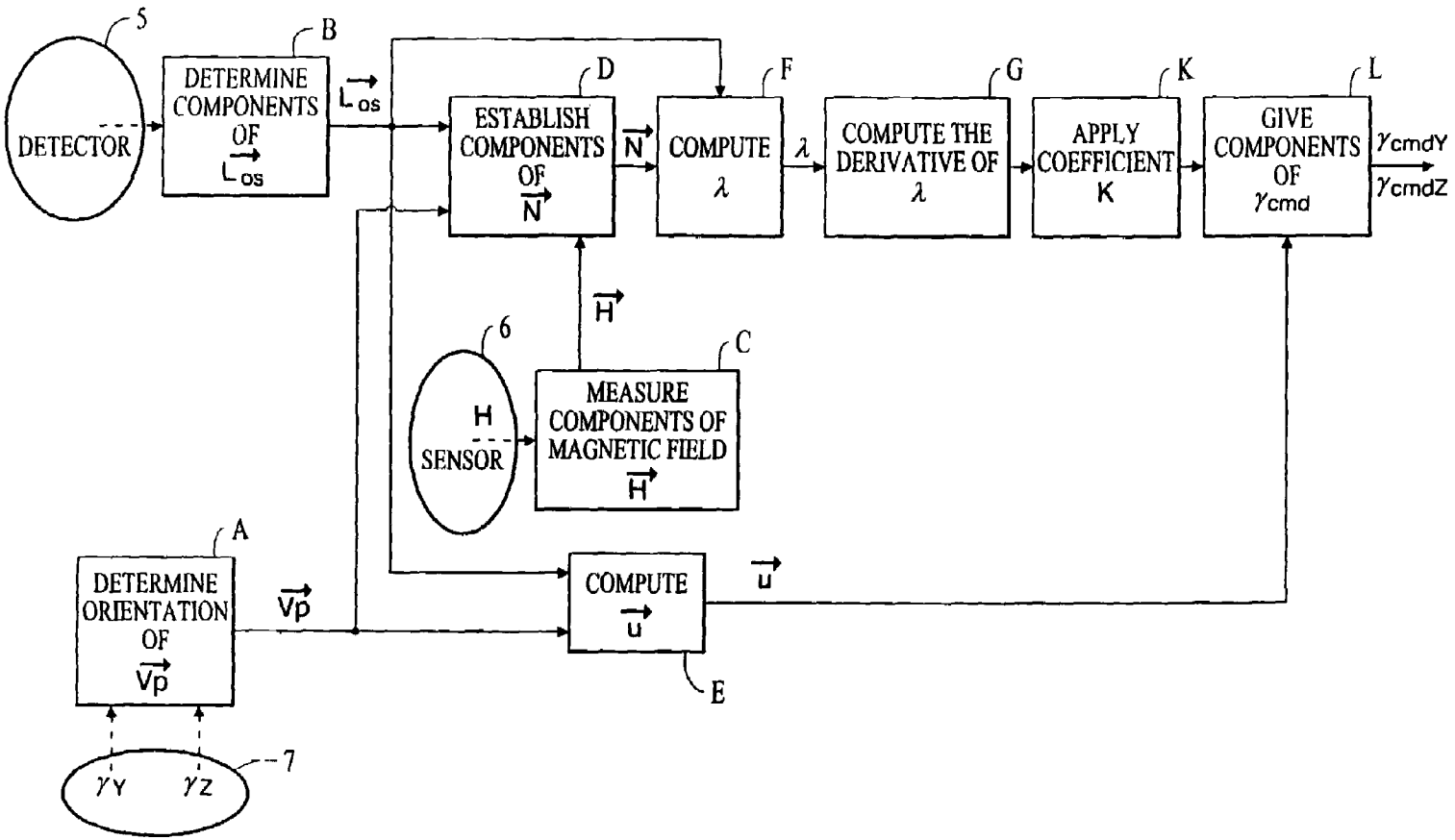
FIG. 4 is a block diagram of the guidance process according to the invention.

FIG. 4 is a block diagram presenting the different steps of the guidance process according to the invention.

Block A corresponds to the determination of the orientation of vector $\overrightarrow{Vp}$ in the projectile reference marker. As specified above, this determination will be, depending on the case, either fixed ($\overrightarrow{Vp}$ oriented along axis $OX_m$), or computed by means of the accelerometers 10*a*, 10*b* which give values for $\gamma_Y$ and $\gamma_Z$).

Block B corresponds to the determination of the components of the unitary vector $\overrightarrow{Los}$ collinear to the line of sight. This computation is a classical computation within the scope of the implementation of fixed detectors 5.

Block C corresponds to the measurement of the three components of the terrestrial magnetic field $\vec{H}$ in a projectile-linked reference marker.

Block D corresponds to the establishment of the three components of the projection $\vec{N}$ of the terrestrial magnetic field vector $\vec{H}$ in the guidance plane defined by the projectile's line of sight $\vec{Los}$ and velocity $\vec{Vp}$ vectors.

This computation involves the components of $\vec{Los}$ and $\vec{Vp}$ (definition of the guidance plane) and those of $\vec{H}$.

For this computation, it is enough to define the intermediate vectors:

$\vec{R}=\vec{Vp}\wedge\vec{Los}$ and $\vec{S}=\vec{R}\wedge\vec{H}$, then to solve the equations:

$\vec{R}\cdot\vec{N}=0$ (which means that vectors $\vec{Vp}$, $\vec{Los}$ and $\vec{N}$ belong to the same plane (guidance plane)), $\vec{S}\cdot\vec{N}=0$ (which means that vectors $\vec{R}$, $\vec{H}$ and $\vec{N}$ belong to the same plane perpendicular to the guidance plane), · represents the scalar product and ∧the vectorial product.

To remove any computational indetermination concerning the vector N of which only the orientation is required for the process according to the invention, one of the components of the vector is fixed arbitrarily, for example $N_{xm}=1$.

Block F corresponds to the computation of angle λ between the line of sight vector $\vec{Los}$ and the projection $\vec{N}$ of the magnetic field thus computed.

This angle is easily computed by solving the equations:

$\vec{N}\cdot\vec{Los}=NL_{os}\cos\lambda$ (N and $L_{os}$ being the norms of vectors $\vec{N}$ and $\vec{Los}$).

$|\vec{N}\wedge\vec{Los}|=NL_{os}\sin\lambda$

It is now possible (Block G) to compute the derivative with respect to time of this angle λ ($\dot{\lambda}=d\lambda/dt$) and apply (Block K) the coefficient K of the guidance law to it.

The estimation of the derivative $\dot{\lambda}$ of angle λ may involve the use of a smoothing filter so as to minimize the noise due to the derivation operation for this angle.

The coefficient K will be selected by the Expert according to the characteristics of the projectile as the approach velocity of the projectile/target. This velocity is estimated from values pre-programmed into the projectile's computer 4 and according to the firing scenario. The value of K may be adjusted in the computer 4 according to the firing scenarios envisaged.

Block E corresponds to the computation of the unitary vector $\vec{u}$ in the projectile-linked reference marker. These coordinates can be easily computed by solving the equations:

$\vec{Vp}\cdot\vec{u}=0$ and $(\vec{Vp}\wedge\vec{u})\cdot\vec{Los}=0$ and norm of the vector $\vec{u}=1$ If the approximation Vp is made collinear to $OX_m$, the vector $\vec{u}$ is located in the plane $Y_mOZ_m$ and its direction is thus simply supplied by the projection of the vector $\vec{N}$ or the vector $\vec{Los}$ in this plane.

Block L gives the components of the control acceleration vector $\vec{\gamma}_{cmd}$ (only components $\gamma_{cmdY}$ and $\gamma_{cmdZ}$ of this vector along the yaw ($OY_m$) and pitch ($OZ_m$) axes are needed to ensure guidance).

Classically, these commands are used by the pitch and yaw steering chains for the fins to as to steer the projectile.

The projectile is steered using a classical steering algorithm. Such an algorithm uses the yaw and pitch acceleration set points given by the computer using the guidance algorithm as well as the values of the accelerations actually measured along the pitch and yaw axes and those of the spin rate (p, q, r) of the projectile respectively around its roll, pitch and yaw axes.

Figure 5A:
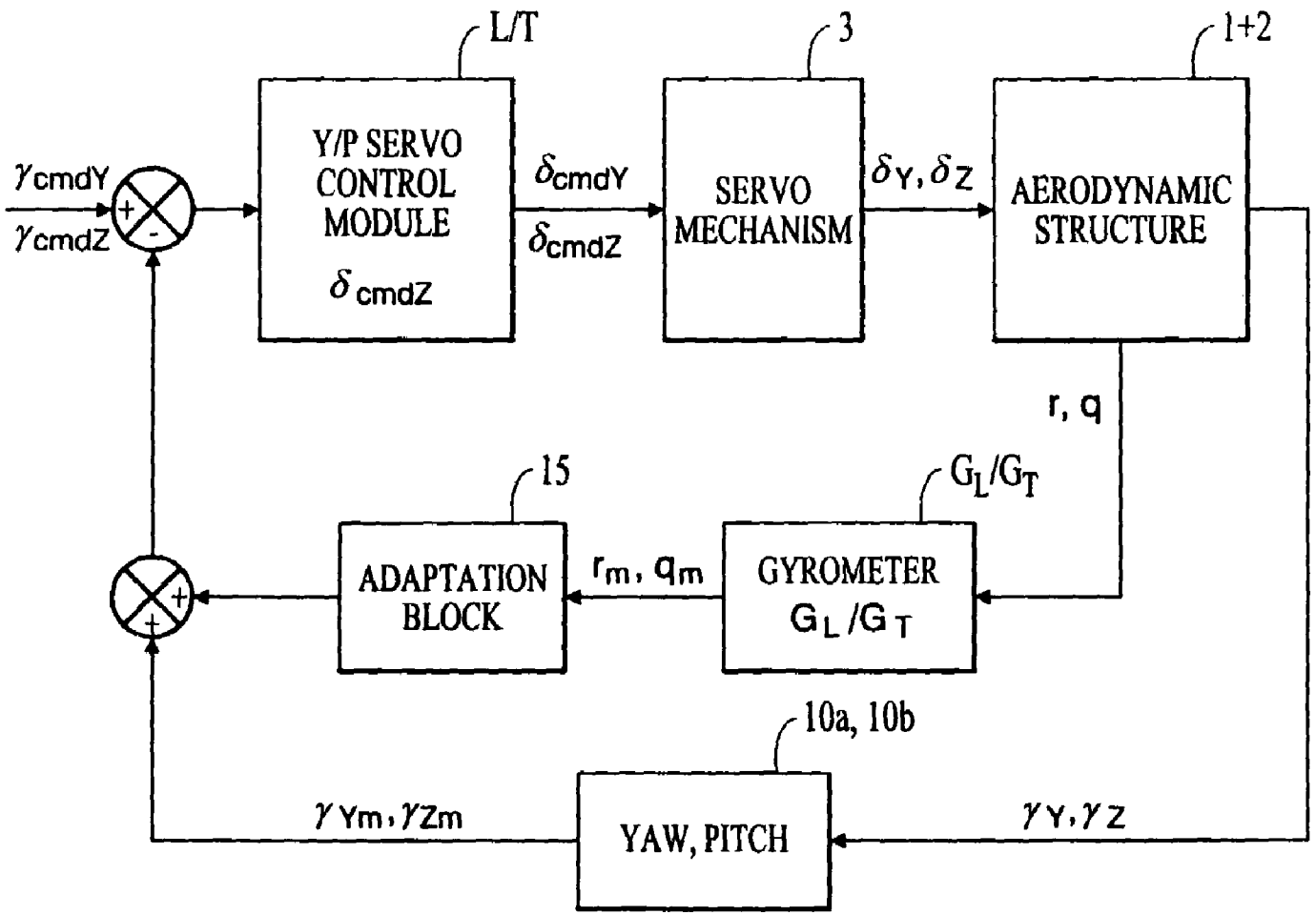
FIGS. 5*a* and 5*b* are functional block diagrams of a classical steering chain.
Figure 5B:
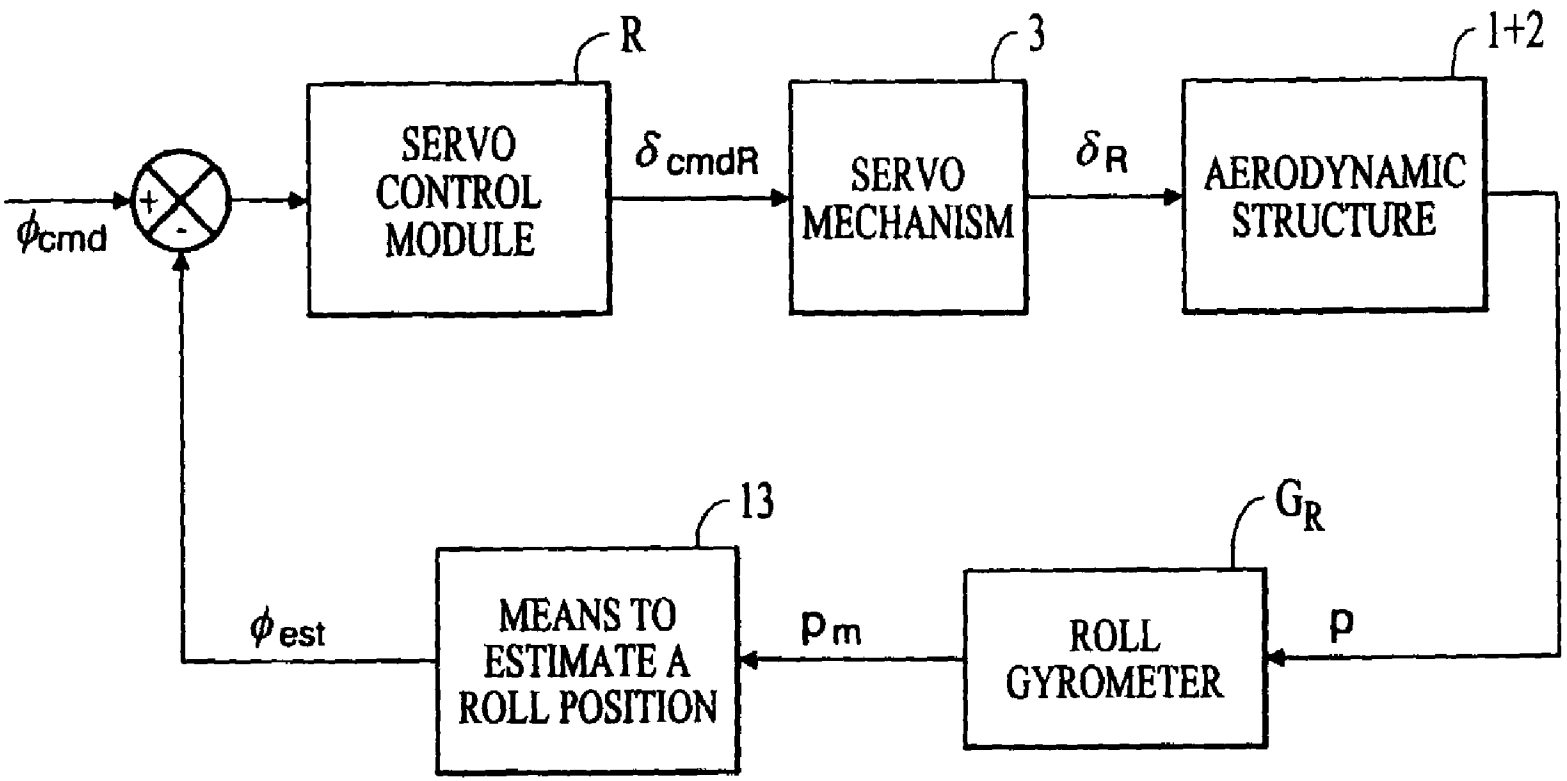

FIGS. 5*a* and 5*b* are block diagrams showing classical steering chains.

FIG. 5*a* shows a yaw or pitch steering chain. This chain comprises a Y/P servo control module for yaw (respectively for pitch) that establishes the yaw deflection $\delta_{cmdY}$ (and respectively pitch $\delta_{cmdZ}$) deflection set point as a function of the acceleration set point $\gamma_{cmdY}$ (respectively $\gamma_{cmdZ}$) and measurements $\gamma_{Ym}$ (or $\gamma_{Zm}$) effectively obtained as well as measurement $r_m$ (or $q_m$) of the spin rate r (or q) around the yaw (or pitch) spin axis.

The set points are communicated by the servomechanism 3 to the fins 2 integral with the projectile 1 (aerodynamic structure 1+2). Naturally, the set point angles $\delta_{cmdY}$ and $\delta_{cmdZ}$ are distributed over the different steering fins according to their geometry, position and number.

The measurements are made respectively by the yaw 10*a* (or pitch 10*b*) accelerometer and by a yaw $G_L$ (or pitch $G_T$) gyrometer. An adaptation block 15 (transfer function) is planned for the gyrometer ($G_L/G_T$) outputs before the signals related to the spin are combined with those supplied by the accelerometers (10*a*, 10*b*).

These servo control algorithms are well known to somebody skilled in the art. Reference may be made, for example, to patent FR847033 which describes a computation process for the deflection angles of canard-type fins.

FIG. 5*b* shows a classical roll steering chain. This chain comprises a roll servo control module R that establishes a roll deflection angle set point $\delta_{cmdR}$ as a function of the roll angle set point $\phi_{cmd}$ required and the measurement $\rho_m$ of the roll velocity ρ. The latter is measured by a roll gyrometer $G_R$ coupled with means 13 to estimate the roll position $\phi_{est}$ (generally constituted by an appropriate algorithm).

These classical steering chains require the implementation of gyrometers ($G_R$, $G_L$, $G_T$) whose performances are lower than those of the gyrometers implemented to ensure guidance.

It is thus possible to implement the invention only for the projectile guidance function, steering being carried out by classical means.

Advantageously, according to another embodiment of the invention, it is possible for a magnetic reference marker to be implemented to ensure steering. In this case, it is no longer necessary for gyrometers to be used.

Figure 6:
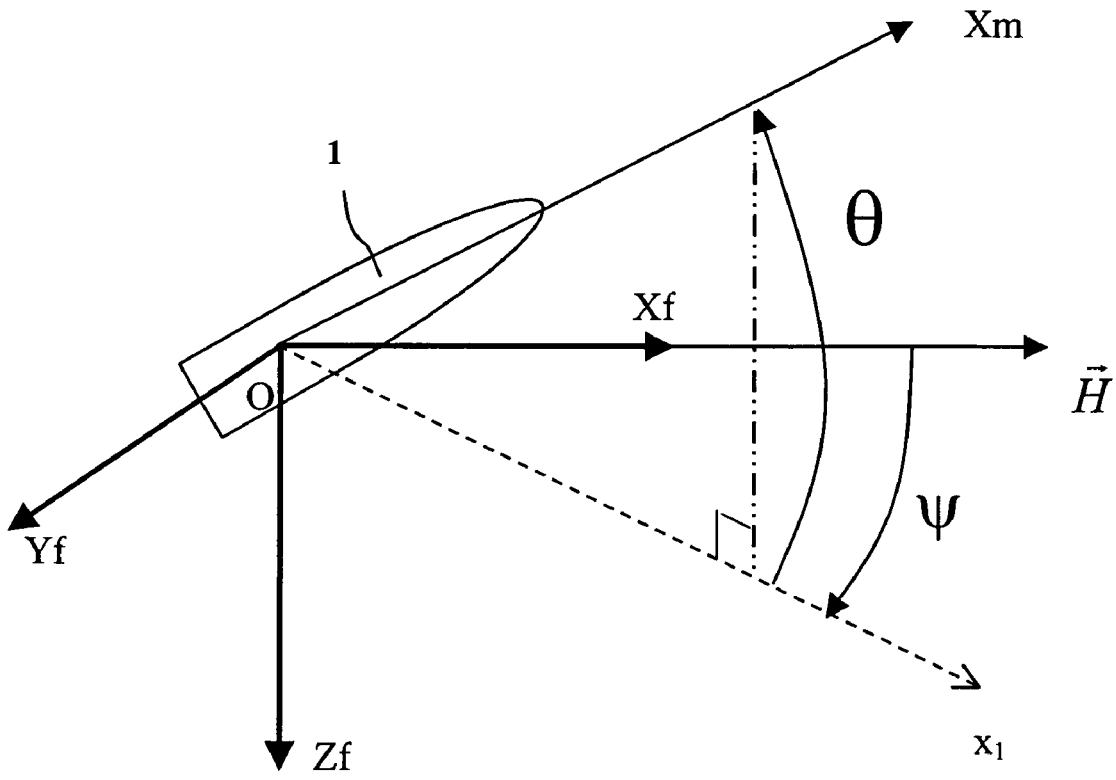
FIG. 6 shows the Euler angles in relation to the magnetic field vector.

FIG. 6 shows the projectile 1 with respect to a fixed reference marker $OX_fY_fZ_f$ brought to the centre of gravity 0 of the projectile. This fixed reference marker is defined such that the terrestrial magnetic field vector $\vec{H}$ blends with the axis $OX_f$. FIG. 6 also shows the axis $OX_m$ of the projectile-linked reference marker.

The passage from one reference marker to another is made by knowing the Euler angles Ψ, Θ and Φ. These angles are usually obtained by integrating the components of the instantaneous spin vector in a projectile-linked reference marker, vector which is usually measured by an on-board inertial measurement unit using gyrometers.

As can be seen from FIG. 6, it is also possible for the magnetic field vector $\vec{H}$ to be expressed in the projectile reference marker as a function of the Euler angles Ψ and Θ only. However, knowing H does not enable Euler angle Φ to be known.

It is thus impossible to directly compute the roll (p), pitch (q) and yaw (r) velocities in the projectile reference marker from the measurement of H. These velocities, however, are normally needed to ensure steering.

According to another embodiment of the invention, the apparent spin (pseudo-gyrometric measurements) of the projection of the terrestrial magnetic field vector in the pitch ($X_mOZ_m$), yaw ($Y_mOX_m$) planes as well as in the $Y_mOZ_m$ plane (perpendicular to the roll axis $X_m$) will be taken into account.

Figure 7A:
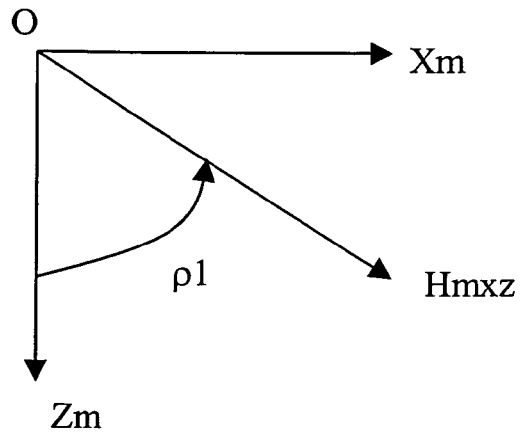
FIGS. 7*a*, 7*b*, 7*c* are schemas showing the vectors and angles computed in the steering process according to the invention.
Figure 7B:
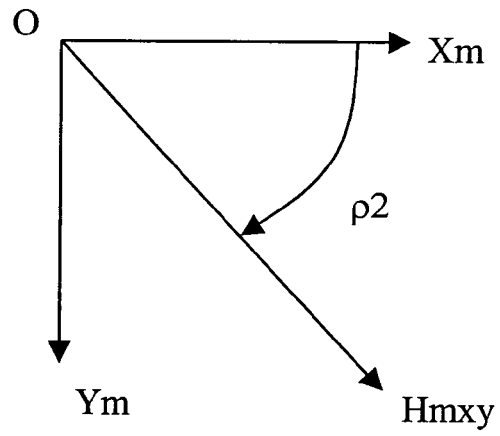
Figure 7C:
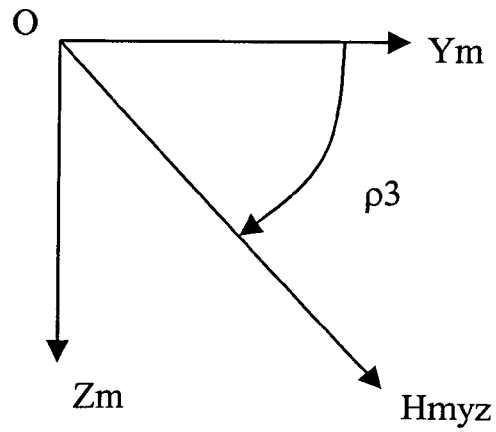

FIGS. 7*a*, 7*b* and 7*c* show these projections.

FIG. 7*a* thus shows the projection $H_{mXZ}$ of the terrestrial magnetic field vector $\vec{H}$ in the pitch plane $X_mOZ_m$. This projection makes an angle $\rho_1$ with axis $OZ_m$.

FIG. 7*b* shows the projection $H_{mXY}$ of the terrestrial magnetic field vector $\vec{H}$ in the yaw plane $X_mOY_m$. This projection makes an angle $\rho_2$ with roll axis $OX_m$.

Lastly, FIG. 7*c* shows the projection $H_{mYZ}$ of the terrestrial magnetic field vector $\vec{H}$ in the plane $Y_mOZ_m$ perpendicular to the roll axis $OX_m$. This projection makes an angle $\rho_3$ with axis $OY_m$.

These projections are easily computed by the computer unit 4 from the measurements of the terrestrial magnetic field vector $\vec{H}$ made by the sensor or sensors 6. Indeed, only the two components of vector H need be retained for the plane in question, the third being nil.

In accordance with the invention, the variations with respect to time ($d\rho_1/dt$ and $d\rho_2/dt$) of angles $\rho_1$ and $\rho_2$ are estimated and these derivatives will be used in the servo control algorithm for the pitch and yaw steering, in place respectively of the pitch q and yaw r spin rates.

It will thus be written $d\rho_1/dt=q_m$ and $d\rho_2/dt=r_m$

In place of $\rho_1$ and $\rho_2$ is it naturally also possible to consider the angles between the projection of the terrestrial magnetic field and the other axes $OX_m$ (FIG. 7*a*) or $OY_m$ (FIG. 7*b*).

Moreover, in the roll servo control algorithm, the value of angle $\rho_3$ computed in place of roll angle $\Phi$ can be used (written: $\rho_3=\Phi_m$). Once again, in place of angle $\rho_3$, the angle between $H_{mYZ}$ and $OZ_m$ may be considered (with the possible application of an angular correction).

In particular, when the terrestrial magnetic field $\vec{H}$ is almost collinear with roll axis $OX_m$, a double-checking device may be used to avoid phase jumps (modulo $\pi$) during the measurement. For example, the value $\Phi_{(m(t+dt)}$ closest to $\Phi_{m(t)}$ may be retained by filtering.

Naturally, the different corrector coefficients of the servo control chains will be selected by somebody skilled in the art according to the mechanical characteristics of the projectile and the servo mechanisms.

A comparative simulation has been carried out between the guidance and steering process according to the invention and several known guidance and steering processes. These known processes are implemented for ammunition with terminal guidance and use full inertial measurement units associating gyrometers and accelerometers both for steering and for guidance, as well as a seeker head employing a deviation finder.

The CEP (circle error probable) is a factor equal to the radius of a circle centered on the target and containing 50% of the impact points of the projectiles fired.

This coefficient is generally of between 0.5 m and 0.9 m for known projectiles.

A simulation has been made of the behavior of a projectile having the same geometry as known projectiles but in which the gyrometers have been removed and replaced by a magnetic sensor measuring the three components of the terrestrial magnetic field in a projectile-linked reference marker.

The computer of this projectile incorporates guidance and steering algorithms such as described above: a guidance law makes the projection of the magnetic field vector intervene on the guidance plane Vp/Los, and a steering algorithm replacing q, r and $\Phi$ by values deduced from the projections of the magnetic field on the pitch, yaw and roll planes.

The CEP for such a projectile is of around 1.5 m, which is perfectly acceptable given the reduced cost of the guidance/steering device implemented.

It is naturally possible for only the steering process to be implemented in a projectile, guidance being obtained in this case by means, for example, of a GPS (satellite positioning system). The process according to the invention, in this case, means that the installation of gyrometers, which are fragile and very costly components, is unnecessary.

In particular, the steering process according to the invention can be associated with a classical guidance process implementing a simple tracking law in place of a proportional navigation law.

The tracking law is well known to the Expert and is implemented for fixed or slow targets. With this law, the velocity vector Vp of the projectile is maintained constantly in the direction of the target detected.

The trajectory resulting from this type of law is known under the name of "dog-leg curve".

To simplify the computations, the velocity vector Vp of the projectile is considered to blend with the axis Xm of the projectile.

The guidance computer will, in this case, supply the pitch and yaw acceleration set points to the steering chain. These set points will be established simply. Using a deviation finder supplying the deviation angles between the projectile's velocity vector Vp (supposed the same as the projectile's axis Xm) and the projections of the line of sight vector $\vec{Los}$ respectively on the pitch and yaw planes.

The value measured for this angular deviation in the pitch plane (plane XmOZm) is compared to a set point value (nil in the present case because this deviation is sought to be cancelled). The difference between this set point value and the measured value is multiplied by a suitable pay-off coefficient before being applied as the acceleration set point at the pitch steering chain input.

The pitch steering chain such as described previously with reference marker to FIG. 5*a* enables the pitch acceleration to be controlled and thus the orientation of the velocity vector Vp in the pitch plane (the spin rate of the projectile's velocity vector Vp being quasi proportional to the normal acceleration applied to the projectile.

The process is performed in the same way in the yaw plane (XmOYm) by applying to the input of the yaw steering chain an acceleration command depending on the angular deviation between a set point (nil in the present case) and the angular deviation measured in the yaw plane between the velocity vector Vp and the projection of the line of sight vector Los on the yaw plane (XmOYm).

The tracking law may be improved classically by firstly taking into account the incidence of the projectile and secondly by introducing a bias enabling the trajectory to be shaped.

The angles of incidence of the projectile may be estimated in pitch and yaw using accelerometers 10*a* and 10*b*.

The estimations of the angles of incidence of the projectile in pitch and yaw will allow the performances of the tracing law to be improved according to a classical process (advanced tracking law).

In any event, the principle of roll control of, the projectile explained previously remains unchanged (FIG. 5*b*).

It is naturally possible for the invention to be applied to a projectile that incorporates any number of steering fins, whether these fins are arranged at the rear part of the projectile (fins) or at the front part (canards).

What is claimed is:

1. A terminal guidance and/or steering process for a projectile towards a target, process in which the orientation of a velocity vector $\overrightarrow{Vp}$ is determined then a guidance law is applied and finally a steering algorithm enabling the projectile to be reoriented towards a target, process wherein the measurements of the three components of the terrestrial magnetic field $\overrightarrow{H}$ are measured in a projectile-linked reference marker ($Ox_mY_mZ_m$) and said measurements are used in the guidance law and/or steering algorithm as a fixed reference marker enabling the orientation at least partially of said projectile-linked reference marker with respect to the terrestrial reference marker.

2. A guidance and/or steering process according to claim 1, wherein a target detector is implemented that enables said target to be detected in a projectile-linked reference marker, and the coordinates of a line of sight vector $\overrightarrow{Los}$ to be deduced between said target and said projectile, process wherein, to ensure steering:

in said projectile-linked reference marker, the projection $\overrightarrow{N}$ of the terrestrial magnetic field $\overrightarrow{H}$ is determined in a guidance plane defined by the line of sight $\overrightarrow{Los}$ of said projectile and velocity $\overrightarrow{Vp}$ vectors, a guidance law proportional to the variation with respect to time $\boldsymbol{\lambda}=d\lambda/dt$ of angle $\lambda$ between this projection $\overrightarrow{N}$ of the magnetic field and said line of sight vector $\overrightarrow{Los}$.

3. A guidance and/or steering process according to claim 2, wherein the guidance law is expressed in the following way: $\overrightarrow{\gamma}_{cmd}=K\boldsymbol{\lambda}\overrightarrow{u}$, expression in which $\overrightarrow{\gamma}_{cmd}$ represents the correction set point acceleration vector, $\boldsymbol{\lambda}$ represents the variation with respect to time ($d\lambda/dt$) of angle $\lambda$ between the projection $\overrightarrow{N}$ of the magnetic field and said line of sight vector $\overrightarrow{Los}$ and $\overrightarrow{u}$ represents a unitary vector perpendicular to said velocity vector $\overrightarrow{Vp}$ of said projectile and located in said guidance plane.

4. A guidance and/or steering process according to claim 3, wherein to determine the orientation of said projectile's velocity vector in said projectile-linked reference marker, one can consider that said vector is collinear to the axis $OX_m$ of said projectile-linked reference marker.

5. A guidance and/or steering process according to claim 3, wherein to determine the orientation of said projectile's velocity vector in said projectile-linked reference marker, one can use the signals supplied by at least two accelerometers oriented respectively along the axes of measurement in pitch ($OY_m$) and yaw ($OZ_m$) of said projectile.

6. A guidance and/or steering process according to claim 1, wherein to ensure the servo control steering of the yaw and/or pitch positioning of the fins of said projectile:

the projection of the magnetic field vector is determined in one of the yaw ($X_mOY_m$) or pitch ($X_mOZ_m$) planes of said projectile, a servo-control chain is used in yaw and/or pitch in place of the yaw and/or pitch spin rate, the derivative with respect to time of an angle made by the projection thus made with one of the axes of the plane in question.

7. A guidance and/or steering process according to claim 6, wherein to servo control the yaw positioning of said fins, one:

determine the projection of the magnetic field vector on said projectile's yaw plane ($X_mOY_m$), compute the variation with respect to time ($r_{mes}=d\rho_2/dt$) of angle $\rho_2$ made by this projection with the roll axis ($OX_m$), in a yaw servo control chain, use value $r_{mes}$ thus computed (pseudo-gyrometric feedback) in place of the yaw spin rate measurement r.

8. A guidance and/or steering process according to claim 6, wherein to servo control the pitch positioning of said fins, one:

determine the projection of the magnetic field vector on said projectile's pitch plane ($X_mOZ_m$), compute the variation with respect to time ($q_{mes}=d\rho_2/dt$) of angle $\rho_1$ made by this projection with the yaw axis ($OZ_m$), in a pitch servo control chain, use value $q_{mes}$ thus computed (pseudo-gyrometric feedback) in place of the pitch spin rate measurement q.

9. A guidance and/or steering process according to claim 1, wherein to servo control the roll positioning of said fins, one:

determine the projection of the magnetic field vector on said projectile's roll plane ($Z_mOY_m$), measure the angle $\rho_3$ made by this projection with one of the axes of said plane (for example the pitch spin axis ($OY_m$)), in a roll servo control chain, use value $\rho_3$ thus computed in place of roll angle $\Phi$.

10. A guidance process according to claim 6, wherein to ensure the guidance of said projectile a tracking law is implemented.

11. A guidance and/or steering device for a projectile towards a target that implements a terminal guidance and/or steering process for a projectile towards a target, process in which the orientation of a velocity vector $\overrightarrow{Vp}$ is determined then a guidance law is applied and finally a steering algorithm enabling said projectile to be reoriented towards a target, such device wherein it associates a target detector or deviation finder, a computer incorporating a projectile guidance and/or steering algorithm, projectile steering means, at least two accelerometers oriented along the projectile's pitch acceleration ($OZ_m$) and yaw acceleration ($OY_m$) measurement axes and one or several magnetic sensors arranged so as to measure the three components of the terrestrial magnetic field vector $\overrightarrow{H}$ in a projectile-linked reference marker, the guidance and/or steering algorithm using components of the terrestrial magnetic field vector $\overrightarrow{H}$ as a fixed reference marker enabling the projectile-linked reference marker to be at least partially oriented with respect to a terrestrial reference marker.

* * * * *